United States Patent [19]

Foster

[11] Patent Number: 4,462,798

[45] Date of Patent: Jul. 31, 1984

[54] KILN CAR FURNITURE MODULE(S)

[75] Inventor: Bryan D. Foster, Holden, Mass.

[73] Assignee: Norton Company, Worcester, Mass.

[21] Appl. No.: 483,987

[22] Filed: Apr. 11, 1983

[51] Int. Cl.[3] ..... F27D 1/12; F27B 9/26

[52] U.S. Cl. ..... 432/258; 432/259; 432/241; 264/58

[58] Field of Search ..... 432/258, 259, 253, 241; 264/57–59

[56] References Cited

U.S. PATENT DOCUMENTS

| | | | |
|---|---|---|---|
| 1,969,126 | 8/1934 | Forse | 25/153 |
| 2,118,641 | 5/1938 | Diamond | 25/142 |
| 2,280,740 | 6/1942 | Klouman | 432/241 |
| 2,537,145 | 1/1951 | Lovatt | 432/241 |
| 2,629,917 | 3/1953 | Lovatt | 432/241 |
| 2,867,888 | 1/1959 | Schalfer et al. | 432/258 |
| 2,871,543 | 2/1959 | Easter | 25/153 |
| 2,879,577 | 3/1959 | Milburn | 25/142 |
| 3,756,581 | 9/1973 | Albertini | 432/258 |
| 3,992,139 | 11/1976 | Lovatt | 432/258 |
| 3,997,289 | 12/1976 | Bowers | 432/241 |
| 4,141,681 | 2/1979 | Lovatt | 432/258 |
| 4,330,267 | 5/1982 | Wood | 432/241 |
| 4,348,175 | 9/1982 | Molina | 432/241 |

FOREIGN PATENT DOCUMENTS

| | | |
|---|---|---|
| 433497 | 7/1934 | United Kingdom . |
| 676026 | 11/1949 | United Kingdom . |
| 734062 | 5/1953 | United Kingdom . |

*Primary Examiner*—Henry C. Yuen

*Attorney, Agent, or Firm*—Walter Fred

[57] ABSTRACT

A stable lightweight low mass recrystallized silicon carbide kiln furniture module (M&M′) adapted for mounting on a kiln car (C, C′) has a plurality of triangularly arranged post support blocks (20, 20′) and hollow one piece vertical posts (30, 30′, 30″, 32, 32′) inserted therein. The posts are provided with vertically spaced ledges (**30*a*, 32*a*) or hollow pins (30*a*′, 32*a*′) or notches 30*a*″ supporting refractory batts (34, 34′, 34″) and hollow end caps (36, 38, 36′) with tie pins (36*a*, 38*a*, 36*a*′) insertable into upper open ends thereof. Thin overlapping tie plates (40, 40′) each with triangularly arranged holes interconnect with and tie the tie pins, (36*a*, 38*a*, 36*a*′) end caps (36, 38, 36′) and posts (30, 30′, 30″, 32, 32′) together and a hollow tie bar (42, 42′) interconnects with and ties the posts (32, 32′) and overlapping inner portions of the tie plates (40, 40′**) together.

10 Claims, 12 Drawing Figures

KILN CAR FURNITURE MODULE(S)

TECHNICAL DISCLOSURE

A kiln car supported high temperature, durable, stable, light weight and low mass refractory structure for supporting and firing ware comprised of triangularly arranged large support blocks and sockets into which are inserted one piece hollow elongated posts with vertically spaced batt support means supporting removable batts at three points within chambers, coupling means, overlapping tie plates and a tie bar interconnecting and tying the upper ends of the posts and tie plates together.

BACKGROUND OF THE INVENTION

1. Field of the Invention

The invention relates to kiln furniture made of refractory material and supported on a kiln car for supporting ware on refractory batts or tiles in stacked and spaced relationship during transportation and firing thereof in a tunnel kiln.

2. Description of the Prior Art

Conventionally, most of the tunnel kiln car supported refractory kiln furniture modules have ware supporting shelves, batts, or tiles, that merely rest either on the supporting ends of, end caps or on a flanged portion of relatively short sections of solid or hollow support columns, posts, or pillars, which are loosely stacked together and not adequately supported or tied together as shown in U.S. Pat. Nos. 3,992,139, 3,997,289, 2,871,543, 2,118,641, G.B. No. 433,497, G.B. No. 734,062, or G.B. No. 676,026. Thus, the loosely assembled module is wobbley, the batt support pillars or posts are prone to shift, as a result of any sudden jar, sufficiently to allow the batts and ware thereon to fall and become damaged.

A more stable structure shown in U.S. Pat. No. 1,969,126 utilizes a plurality of hollow posts of circular cross section including integral vertically spaced ledges on which four arcuately shaped corners of each of the abutting removable batts or shelves rest upon and which are interconnected and tied together by top end caps and top batts or plates.

Other kiln car structures utilizing hollow posts installed into and supported by heavy base blocks and connected by tie bars supporting a single upper level of shelves are disclosed in U.S. Pat. Nos. 4,330,267 and 4,348,175.

Still another kiln car structure shown in U.S. Pat. No. 4,141,681 comprises a single chamber between a single base block with triangularly arranged sockets supporting three triangularly arranged hollow posts into which are inserted circular caps with projections thereon extending through triangularly arranged holes in a single interconnecting top shelf.

A further kiln car structure comprising triangularly arranged sectional pillars of square cross sectional shape each supporting one or more adjacent shelves each notched out and supported at three places, is disclosed in U.S. Pat. No. 2,879,577.

The instant invention provides a stable multiple chamber kiln furniture module adapted for mounting on and movement with a kiln car. The module comprises at least three rows of relatively long hollow one piece integral posts of polygonal cross sectional shape arranged in a series of adjoining triangular shape patterns. The triangularly arranged posts are rigidly interconnected and supported at their opposite ends independently of the easily removable vertically spaced horizontal shelves each supported at three points by integral ledges or removable pins projecting from the posts.

SUMMARY OF THE INVENTION

A stable multi-chamber refractory kiln furniture module supportable on and by the thermally insulating refractory base members of a kiln car for supporting and transporting multiple stacks of ware in spaced and stacked relationship during firing in a kiln. Each module, which is generally of rectangular shape including four corners, comprises two outer rows extending between the corners and an intermediate row of large base post support blocks with deep sockets into which the mating lower end portion of long one piece, rectangular, or square lightweight hollow refractory posts are inserted and extend upwardly to upper ends thereof situated in the same horizontal plane. The rows of blocks and posts are arranged and secured on the kiln car in a number of adjoining and interconnectable triangular patterns in which the distance between the centers of adjacent outer posts represents a base of a triangle and the center of an intermediate post serves as the apex of a pair of opposing triangles. Refractory caps with upwardly projecting pins are inserted into the upper end portions of the posts and interconnected by a plurality of overlapping horizontal refractory plates with triangularly arranged aperatures and a refractory tie bar extending between and interconnecting the intermediate caps and posts and attached refractory plates together. Each refractory post has vertically spaced integrally formed notches, ledges, or refractory pins projecting from one or both opposite sides of the posts and on which horizontal refractory ware support batts or shelves placed thereon are each supported at three places in a single plane, do not abut or support one another, and are easily removeable and/or replaceable without dismantling of any other part of the module.

DESCRIPTION OF THE PREFERRED EMBODIMENT(S)

Figure 2:
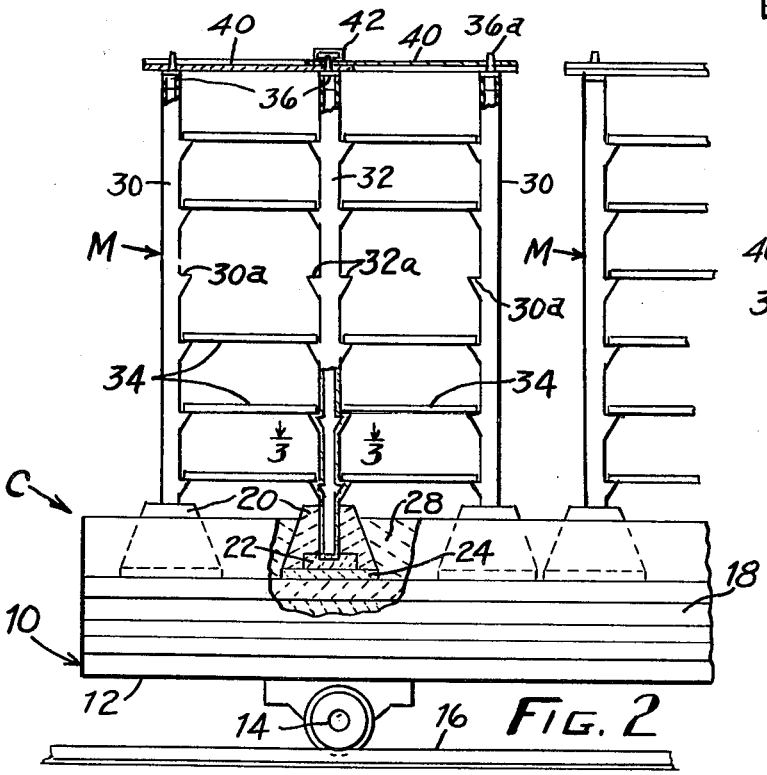
FIG. 2 is a side view partly in section of the kiln car and the kiln furniture module of FIG. 1.

Typically, kiln cars for supporting and transporting kiln furniture and ware thereon into and out of a kiln vary in length and width, and support one or more units or modules M of kiln furniture. A kiln car C of which only a portion is shown in FIG. 2 may be, for example, 22 feet (6.70 m) long×6 feet (1.829 m) wide and support five modules of kiln furniture thereon. The kiln car is usually provided with an undercarriage 10 comprising a structural metal base 12 adequately supported on two or more spaced axle and rotatable wheel assemblies 14 movable upon a pair of guide rails 16 which extend into a kiln adapted to attain the desired ware firing temperature.

The structural steel base 12 is usually protected from the kiln temperatures by a composite thermal insulating base 18 comprising a number of layers of refractory members (plates and/or blocks) arranged and supported thereon.

The refractory insulating base 18 has a generally flat top surface upon which one or more self supporting stable kiln furniture superstructures or modules M of the invention are erected and retained thereon. Each module M preferably of about 4 feet (1.219 m) by 6 feet (1.829 m) wide at the top and about 8 feet (2.438 m) in height comprises a plurality of rows of relatively heavy refractory post support blocks 20 of any suitable polygonal rectangular, square, truncated triangular or truncated pyramidal and other multi-sided shapes. The preferred truncated pyramidal shape blocks 20 each have a large flat recessed base or bottom surface **20*a* typically 15"×15" (38.1 cm×38.1 cm) square, a height of about 11" (27.94 cm), a central 2"×4" (5.08 cm×10.16 cm) rectangular or 4" (10.16 cm) square post receiving post hole or socket 20*b*, generally flat inclined sides extending to a top surface of about 8" (20.32 cm) square and a bottom recess into which a suitable rectangular or square refractory base plug or block 22 has been inserted. The block 20 and inserted block 22 which receive the bottom end of the post 30 or 32 both rest on a refractory base plate 24 supported on the upper surface of the insulating refractory base 18. Each block 22 has a central recess which receives the mating lower closed end portion of either a vertical outer post 30 or an inner intermediate post 32 inserted and preferably mortared in and extending through the vertical post hole 20*b*** of closely fitting mating configuration.

Figure 1:
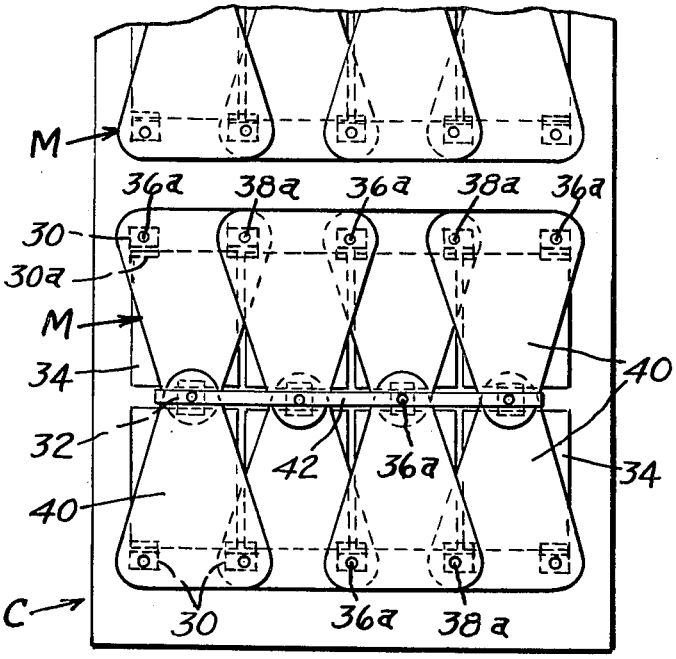
FIG. 1 is a top view of a portion of a kiln car including one embodiment of a kiln furniture module of the invention thereon.
Figure 3:
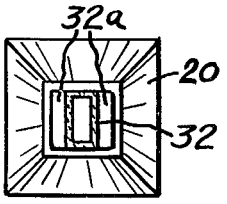
FIG. 3 is a cross-sectional view through one of the hollow rectangular posts inserted into and supported by a support block taken on line 3—3 of FIG. 2.

As shown in FIGS. 1 and 2 the support blocks 20, plates 24 and outer posts 30 and inner posts 32 therein are arranged and aligned on the kiln car C in two outer and an inner or intermediate parallel rows wherein the centers of the outer posts 30 and sockets of the outer block 20; and the outer rows are substantially the same distance from the centers of the intermediate staggered row of posts 32 and sockets of the intermediate blocks 20. Also, it can be seen that each of the staggered intermediate posts 32 and its support block 20 are situated substantially in a vertical plane midway between the planes of two pairs of adjacent outer posts 30 and support blocks 20. Thus, each of the outer rows have an equal number of outer posts 30 including at least two at opposite ends of each row defining the four corner posts of the module M and one more post and block than in the intermediate row. From such an arrangement it can be seen that the outer and intermediate posts 30 and 32 are situated in a plurality of adjoining interconnectable triangular patterns wherein the distance between each pair of adjacent outer posts 30 represent the base of and a single intermediate post 32 serves as the apex of a pair of opposing triangles.

To maintain the outer and intermediate posts and blocks in position and precise triangular arrangement the space between the blocks 20 is filled nearly to the tops thereof with a castable refractory insulation material 28 such as alumina which in essence entraps and secures the blocks 20. The one piece posts 30 and 32 snuggly fitting or motared into and supported by the blocks are preferrably made of refractory material such as recrystallized silicon carbide or alumina adaptable to resist and remain stable at extremely high temperatures and readily slip cast to the desired shape and precise size as disclosed in U.S. Pat. No. 2,964,823 incorporated herein by reference, and to which reference may be had for details not disclosed herein. Each hollow post 30 and 32 has, in this instance, a rectangular cross sectional shape of 2"×4" (5.08 cm×10.16 cm) wide, integrally formed side walls of about ¼" (6.3498 mm) thick and a length of about 8 feet (2.438 m) extending between the closed lower end and an open upper end thereof. Integral vertically spaced batt or shelf support ledges **30*a* project about 1" (2.5 cm) from the inner wider side of each outside post 30 and similar ledges 32*a* project from both of the opposite wider side walls of the intermediate posts 32. The ledges 30*a* and 32*a*, vertically spaced about 8" (20.32 cm) apart, are arranged facing one another and at the same vertically spaced elevations whereby two ledges 30*a* and a single ledge 32*a* at the same level support a 17" (43.18 cm)×20½" (52.07 cm)×¾" (1.9 cm) thick rectangular refractory support shelf or batt 34** at three points or places in the same horizontal plane.

As shown in FIGS. 1 and 2, the module M has a total of eight (8) bays and stacks of the vertically spaced shelves 34 of which there are four (4) stacks located on each of the opposite sides of the intermediate posts 32. As seen in FIG. 1, each of the intermediate posts 32 and opposite ledges **32*a* thereon are arranged and adapted to supportingly engage substantially the mid portion of one side of each batt 34 in two of the adjacent stacks thereof and each outer post 30 and ledges 30*a*, except the corner posts supportingly engages each of the diagonally opposite corners of two batts in adjacent stacks of batts 34, while each corner post 30 and ledges 30*a* engage the diagonal opposite outer corner of each batt 34** in an outer corner stack.

Interconnecting stabilizing means are provided at the top of the module M for interconnecting and tying the posts 30 and 32 together into a self supporting open refractory structure or frame independently of the easily removable batts 34 normally spaced from one another and the posts. Thus the batts 34 which merely extend horizontally between and rest on three ledges, do not provide any substantial amount of lateral stability to the structure or module M.

Figure 4:
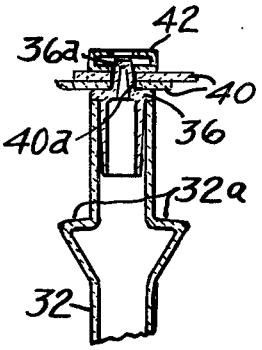
FIG. 4 is a partial cross sectional view through the upper end portion of one of the intermediate hollow posts and end cap with a central pin interconnecting tie plates and a tie bar.
Figure 5:
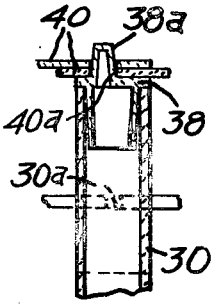
FIG. 5 is a cross-sectional view of an upper portion of an outer hollow post and an end cap with an offset pin interconnecting overlapping tie plates.
Figure 6:
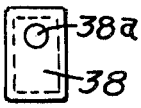
FIG. 6 is a top view of the rectangular end cap with the offset pin shown in FIG. 5.

The stabilizing means comprises, as shown, coupling means such as a plurality of central and offset hollow refractory 2"×4" (5.08 cm×10.10 cm) end caps or plugs 36 and 38 of rectangular cross sectional mating shape adapted for and inserted about 4" (10.16 cm) into the upper rectangular open ends of the posts 30 and 32. A central end cap 36 which has about a 1" (2.54 cm) diameter slightly tapered central pin 36*a* extending upwardly about 1" (2.54 cm) as shown in FIG. 4 is inserted into each of the intermediate posts 32 and in all but the outer posts 30 situated adjacent each of the corner posts 30 in each of the outer rows, each provided with an offset end cap 38 including an offset pin 38*a* of like dimensions as shown in FIGS. 5 and 6.

Interconnecting and tying the caps 36, 38, and posts 30 and 32 together are a plurality of overlaping interchangeable refractory tie plates 40 preferrably of triangular shape, but which may be of any other suitable polygonal or circular shape. The tie plates 40 are of identical interchangeable 21¼"×26½" (51.4 cm×67.3 cm) triangular shape and thickness of about 5/16" (7.937 mm) and each is provided with three triangularly arranged and precisely spaced 1 1/32" (2.61 cm) diameter holes or apperatures 40*a* into and through which the mating upright pins 36*a* and 38*a* of the end caps extend.

As shown, each refractory tie plate 40 connects and ties two (2) outer posts 30 of which one has a central end cap 36 and pin 36*a* and the other an offset end cap 38 and pin 38*a* to an intermediate post 32, central cap 36 and a central pin 36*a* that connects or ties overlaping apex portions of adjacent tie plates 40 together. Each outer post 30, cap 36 or 38 and pin 36*a* or 38*a* except the corner posts 30 with caps 36 and pins 36*a* in the outer rows, connects and ties together the diagonally opposite overlapping corner portions of adjacent tie plates 40. Thus, the overlapping interconnecting tie plates 40 connect and tie the posts 30 and 32 together. Additional stability is also provided by an elongated hollow refractory tie bar 42, 1" (2.54 cm) thick×4" (10.16 cm) wide and about 5 feet (1.524 m) long including 1⅛" (2.85 cm) diameter holes 42*a* in ¼" (6.3498 mm) thick walls, the tie bar 42 extends between, interconnects and ties the entire row of intermediate posts 32, caps 36 and pins 36*a*, overlapped apex portion of the batts 34 together into a self supporting relatively light weight refractory kiln furniture module M.

Another embodiment of a kiln furniture module M' according to the invention is shown in FIGS. 7–12 supported on a kiln car C' including an undercarriage 10', a structural metal base 12' supported on wheel assemblies 14' movable on rails 16' extending through a tunnel kiln and a refractory thermal insulating base 18' similar to those of kiln car C and all of which support one or more kiln furniture modules M'. The refractory kiln furniture module M' is preferrably supported in similar sized truncated pyamidal shape refractory blocks 20' with square bottoms 20*a'* and 3" (7.62 cm) or 4" (10.16 cm) square post holes 20*b'* resting on refractory plates 24' retained on the base 18' by cast refractory 28'. However, 12"×12"×18" (30.48 cm ×30.48 cm×45.7 cm) long or high blocks may be used instead.

Inserted into and supported by the blocks are a plurality of identical 3" (7.62 cm) or 4" (10.16 cm) square hollow outer posts 30' and intermediate posts 32' arranged as before in two outer and intermediate parallel rows of from about 28½" (72.39 cm) to 33½" (85.09 cm) apart on centers, but with two less posts and blocks in each row spaced about 21½" (54.6 cm) to 24" (60.96 cm) on center. However, both of the modules M and M' are of substantially the same size and capacity but arranged differently on the car. That is, the rows of triangularly arranged posts 30' and 32' in module M' extend lengthwise of the car C' instead of going cross-wise as in module M. Thus, it is obvious, that the posts in module M' are spaced further apart and provide four (4) larger bays and stacks of larger refractory batts or shelves 34' between them than the greater number and more closely spaced posts, smaller bays and stacks of batts in module M.

Figure 7:
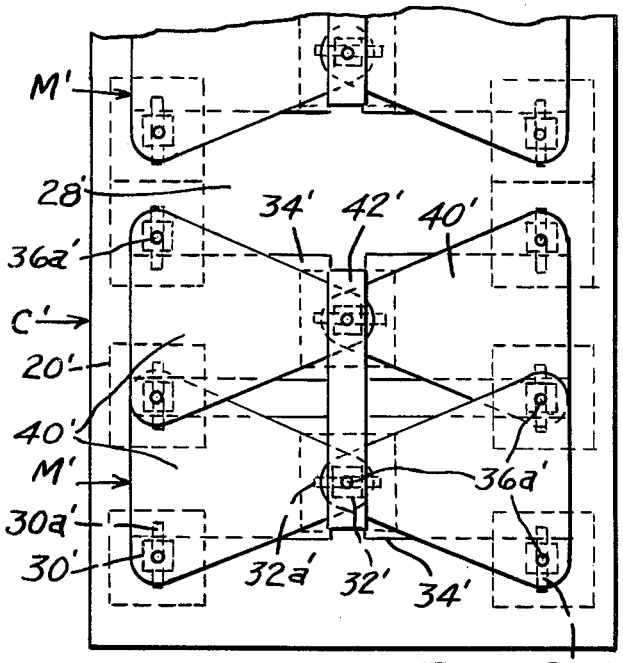
FIG. 7 is a top view of a portion of a kiln car including another embodiment of a kiln furniture module according to the invention thereon.
Figure 10:
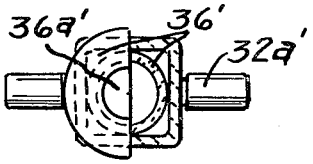
FIG. 10 is a top view partly in section of the circular end cap mounted in the upper end of the hollow square post taken on line 10—10 of FIG. 9.

In module M' the outer square posts 30' and intermediate square post 32' are identical and are each provided with a plurality of vertically spaced ½" (12.7 mm) diameter or square pin receiving holes into and through which hollow or solid mating refractory pins 30*a'* and 32*a'* of 6" (15.24 cm) to 9" (22.86 cm) long extend to supportingly engage a portion of each shelf or batt 34'. As shown in FIG. 7 the outer row of posts 30' are arranged with base block 20' so the holes and pins 30*a'* extend in the plane and length of the rows while the intermediate row of posts 32', holes and pins 32*a'* are rotated 90° C. and inserted in the blocks so they extend crosswise and normal to the plane of the rows.

Figure 9:
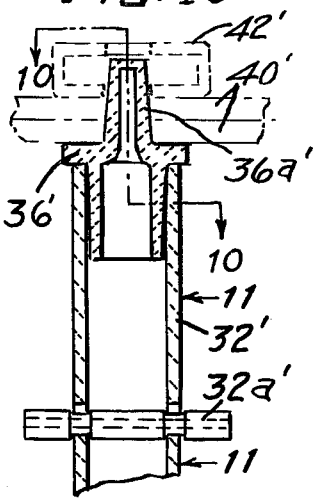
FIG. 9 is a cross sectional view through the upper portion of a rectangular hollow post including a circular end cap with a central pin inserted therein and a batt support pin extending through the opposite sides of the post.
Figure 8:
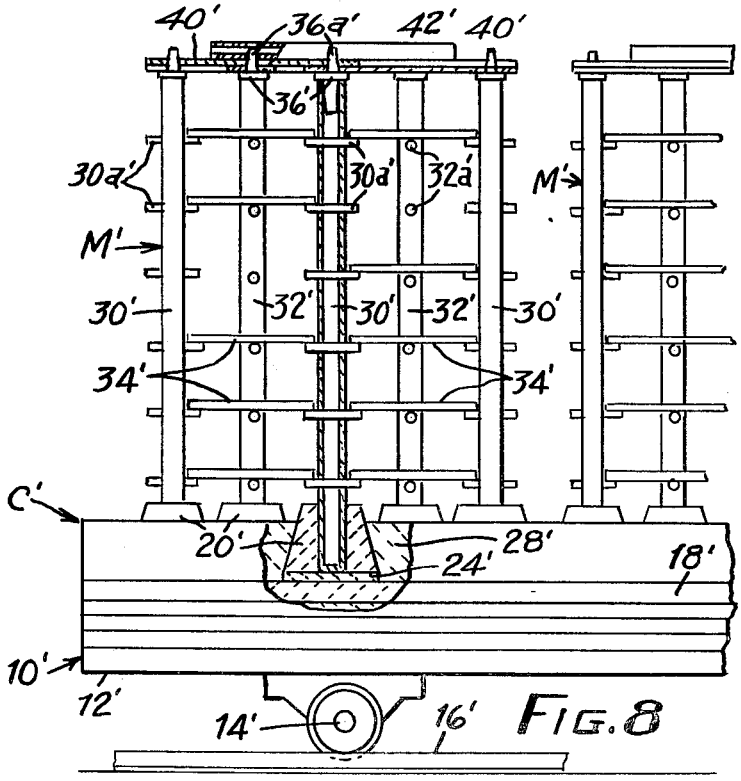
FIG. 8 is a side view partly in section of the kiln car and kiln furniture module of FIG. 7.
Figure 11:
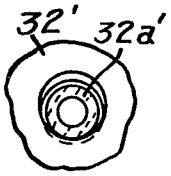
FIG. 11 is a cross sectional view through the reduced retaining portion of a hollow support pin taken at the wall line 11—11 of FIG. 9.

With the exception of the corner post and pins 30*a'* which support the outer corner portions of outer batts 34', the opposite end portions of the pins 30*a'* extending through opposite sides of the posts 30' supportingly engage the adjacent corner portions of adjacent batts 34' in adjacent stacks thereof. Likewise, the intermediate pins 32*a'* extend through the intermediate posts 32' and support the inner central edge portions of adjacent batts 34' in adjacent bays and stacks thereof. Thus, each of the batts 34' are supported at three triangularly arranged points or places located in a horizontal plane and are easily removed and replaced from opposite sides of the kiln car C'. As shown in FIGS. 9 and 11 each of the hollow batt support pins 30*a'* and 32*a'* have axially spaced shoulders and adjoining grooves of reduced diameter or square cross section into which the supporting portions of the walls adjoining the bottom of the holes fit into and help maintain them in a centralized position. Alternatively, the central portion could be of either the same reduced diameter or square cross section extending between inner shoulders of the end portions of larger diameter or of the larger central diameter or square section extending axially between opposite end shoulders and end portions of reduced diameter or square section. In all cases the reduced portions engage the wall at the bottom of the hole and the shoulders would engage the sidewalls and deter accidental axial displacement thereof.

Inserted in the upper square open end portion of each post 30' and 32' are coupling means comprising a hollow end cap 36' of circular cross sectional shape adapted with an upwardly extending slightly tapering central pin portion 36*a'* of sufficient length to pass through holes in two overlapping portions of adjacent larger refractory tie plates 40' and a shorter tie bar 42' interconnecting and tying the caps 36' and posts 30' and 32' together into a self supporting stabilized structure or module M'.

As seen in FIG. 7 the four overlapping triangular shape tie plates 40' are larger than but otherwise connect the posts 30' and 32' in the same manner as does the tie plates 40 and the tie bar 40' is merely shorter in length than the tie bar 40 in module M. The tie plate being approximately from about 24½" (62.2 cm) wide and from 31½" (80 cm) to 38½" (97.79 cm) long.

Figure 12:
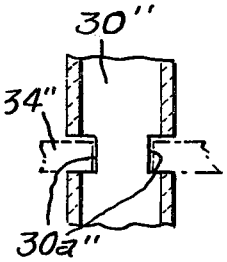
FIG. 12 is a cross-section view through a portion of an alternative hollow post provided with notches in the side wall thereof for insertion of and supporting the batts or shelves.

In FIG. 12 is shown a rectangular or square post 30" provided with spaced notches 30*a*" in the walls thereof instead of projecting ledges 30*a* and pins 30*a*' and into which the batts or shelves 34" are inserted and rest on the notched surface of the walls.

Preferrably, all of the components of the kiln furniture modules M and M' are of recrystalized silicon carbide refractory material constructed as by molding, hot pressing or slip casting silicon carbide particles in the known manner and firing the molded or cast shape in a kiln to recrystallize the silicon carbide. A preferred method of slip casting silicon carbide particles and firing the cast shapes to recrystallize the silicon carbide is disclosed in U.S. Pat. No. 2,964,823 incorporated herein by reference for details not disclosed herein.

However, the refractory components including the entrapped support blocks may be of any other suitable refractory material such as Alumina, zirconia, silicon carbide, and mixtures thereof which can withstand the high kiln temperature required to fire the ceramic ware.

Alternatively, the one piece posts may be provided with integrally formed central and offset pins at the top ends thereof instead of the separate end cap and pins shown.

As many other embodiment and modifications of the instant invention are possible it is to be understood that the preferred embodiments disclosed and shown are for illustrative purposes only and that the invention includes all modifications and equivalents thereof falling within the scope of the appended claims.

I claim:

1. A refractory kiln car furniture module for supporting refractory and ceramic ware in spaced and stacked relationship within a plurality of adjacent bays during firing thereof in a kiln comprising:

At least three spaced rows of relatively large refractory post support blocks having post sockets of predetermined depth and configuration supported by and triangularly arranged on a thermally insulated refractory base structure of a kiln car so as to provide two outer rows each of at least three outer post support blocks and sockets and, an intermediate row of at least two intermediate post support blocks and sockets arranged so that each pair of adjacent outer sockets and each one of the intermediate sockets are in an interconnectable triangular pattern;

A plurality of triangularly arranged vertical outer and intermediate refractory posts supported by and extending upwardly from the respective outer and intermediate blocks and triangularly arranged sockets having upper end portions and lower end portions fitted into the triangularly arranged sockets of the blocks;

refractory batt support means on and vertically spaced along sides of the posts for supporting engagement with at least three triangularly spaced edge portions of each batt in each stack of batts in adjacent bays of the module;

a plurality of refractory batts resting horizontally on and supported by the support means at at least three triangularly spaced edge portions of each batt in each bay of the module:

refractory coupling means including tie pins extending upwardly from the upper end of each outer and intermediate post;

A plurality of overlapping horizontal refractory tie plates, each having triangularly arranged holes into which three of the tie pins extend, interconnect, and tie the upper end portions of the outer and intermediate posts together; and a tie bar with at least two holes therein adapted to receive at least two tie pins, extending between, interconnecting, and tying the intermediate posts and inner overlapping portions of the tie plates together.

2. A refractory kiln car furniture module according to claim 1 wherein the outer and intermediate posts and the post sockets in the outer and intermediate blocks have a mating rectangular or square cross sectional configuration.

3. A refractory kiln car furniture module according to claim 2 wherein the outer and intermediate posts are one piece hollow posts each having a continuous integral elongated sidewall of mating hollow rectangular or square cross sectional configuration and wherein the refractory batt support means comprises integral inner ledges projecting from at least one inner side of the outer posts and intermediate ledges projecting from both opposite sides of the intermediate posts whereby the intermediate ledges supportingly engage inner central edge portions of adjacent batts on opposite sides of the intermediate posts and the inner ledges supportingly engage diagonally opposite corner portions of adjacent batts on inner sides of the outer posts.

4. A refractory kiln car furniture module according to claim 1 wherein the refractory batt support means comprises:

a plurality of refractory support pins extending horizontally through and beyond opposite sides of each of the outer and intermediate posts arranged in the post sockets of the blocks so the pins in each of the intermediate posts are situated in a vertical plane substantially at right angles to a vertical plane of the pins in the outer rows of outer posts whereby opposite end portions of the pins in the intermediate posts supportingly engage inner central edge portions of adjacent batts on opposite sides of the intermediate posts while opposite end portions of the pins in the outer posts supportingly engage diagonally opposite outer corner portions of adjacent batts on opposite sides of the outer posts.

5. A refractory kiln car furniture module acording to claim 4 wherein the posts are hollow one piece posts of rectangular or square cross sectional configuration and have support pin holes in opposite side wall portions of the hollow posts of the same cross sectional mating shape and maximum size adapted to receive the refractory pins and wherein the refractory support pins insertable in the mating support pin holes each have at least one reduced portion less than the maximum cross sectional size of the pin for supporting engagement with an inner bottom surface portion of each opposite sidewall at the bottom of each pin hole.

6. A refractory kiln car furniture module according to claim 1 wherein each of the refractory tie plates comprises:

a triangular shape refractory plate having an intermediate pin hole located in a central corner portion of the triangular plate adapted for receiving the tie pin of the coupling means attached to a intermediate post, and two outer pin holes in diagonally opposite corner portions of the triangular plate adapted for receiving adjacent tie pins of the coupling means attached to a pair of adjacent outer posts.

7. A refractory kiln car furniture module according to claim 1 wherein the coupling means comprises:

hollow refractory end caps each having a lower portion adapted for coupling the cap to the upper end portion of a post, an intermediate cap portion adapted to rest on the upper end of a post and an upper tie pin portion adapted to fit in the pin holes of the tie plate and tie bar and to extend upwardly from the intermediate cap portion sufficiently to pass through the overlapping portions of adjacent tie plates and into the tie bar.

8. A refractory kiln car furniture module according to claim 7 wherein each of the end caps on an outer adjacent post situated between a pair of outer posts in each of the outer rows has an offset upper tie pin portion which extends through pin holes of overlapping portions of adjacent tie plates offset from the central axis of the end cap and the outer adjacent post.

9. A refractory kiln car furniture module according to claim 1 wherein each of the outer and intermediate refractory post support blocks comprises:

a monolithic truncated pyramid shape refractory block having a relatively large square flat bottom inwardly inclined sides extending upwardly from the bottom to a top side and a central post receiving socket extending vertically between the top and bottom sides of the support blocks and made of refractory material selected from alumina, silicon carbide, zirconia, recrystalized silicon carbide and mixtures thereof.

10. A refractory kiln car furniture module according to claim 1 wherein the refractory posts, refractory batt support means, the refractory batts, the refractory coupling means, the tie plates and tie bar are comprised of recrystallized silicon carbide refractory material.

* * * * *